US008643292B2

(12) United States Patent
Tang et al.

(10) Patent No.: US 8,643,292 B2
(45) Date of Patent: Feb. 4, 2014

(54) DIGITAL DIMMING DEVICE AND DIGITAL DIMMING METHOD

(75) Inventors: Chien-Fu Tang, Hsinchu (TW); Isaac Chen, Zhubei (TW); An-Tung Chen, Pingzhen (TW)

(73) Assignee: Richtek Technology Corporation, Chupei, Hsin-Chu (TW)

( * ) Notice: Subject to any disclaimer, the term of this patent is extended or adjusted under 35 U.S.C. 154(b) by 595 days.

(21) Appl. No.: 12/925,504

(22) Filed: Oct. 22, 2010

(65) Prior Publication Data

US 2011/0109238 A1 May 12, 2011

(30) Foreign Application Priority Data

Nov. 12, 2009 (TW) ..... 98138391 A

(51) Int. Cl.
*G05F 1/00* (2006.01)

(52) U.S. Cl.
USPC ..... 315/194; 315/291; 315/185 R; 345/46; 345/82; 345/204

(58) Field of Classification Search
USPC ..... 315/299, 185, 360, 291, 294, 312, 307, 315/297, 169.1, 185 R, 287, 194; 345/690, 345/691, 204, 42, 46, 82, 63, 211, 212, 207
See application file for complete search history.

(56) References Cited

U.S. PATENT DOCUMENTS

| | | | | |
|---|---|---|---|---|
| 7,259,687 | B2 | 8/2007 | Wiktor et al. | |
| 2008/0048582 | A1* | 2/2008 | Robinson | 315/291 |
| 2008/0068203 | A1* | 3/2008 | Bai et al. | 340/815.78 |
| 2009/0134817 | A1 | 5/2009 | Jurngwirth et al. | |
| 2010/0181941 | A1* | 7/2010 | Kuo et al. | 315/320 |

* cited by examiner

*Primary Examiner* — Daniel Cavallari
*Assistant Examiner* — Borna Alaeddini
(74) *Attorney, Agent, or Firm* — Tung & Associates

(57) ABSTRACT

The present invention discloses a digital dimming device and a digital dimming method, for controlling a plurality of light emitting device channels. The method comprises: generating a corresponding plurality of driving signals to control the plurality of light emitting device channels; receiving a PWM input signal having a duty ratio, and phase shifting the PWM input signal to generate multiple PWM output signals with about the same duty ratio as the PWM input signal, but with respectively shifted phases; and enabling or disabling corresponding driving signals by the multiple PWM output signals, respectively.

15 Claims, 6 Drawing Sheets

DIGITAL DIMMING DEVICE AND DIGITAL DIMMING METHOD

BACKGROUND OF THE INVENTION

1. Field of Invention

The present invention relates to a digital dimming device and method, in particular to one that uniformly distributes the illumination timings of multiple strings of light emitting devices.

2. Description of Related Art

In a circuit for controlling light emitting devices (such as light emitting diodes, LEDs), a dimming function is often required. Two dimming methods have been proposed in prior art to deal with the case where there are multiple strings of light emitting devices. The first one is shown in FIG. 1, wherein the same dimming control signal is used to adjust the brightness of every string of light emitting devices. The second one is shown in FIG. 2, wherein different dimming control circuits are used to dim corresponding light emitting device strings. More specifically, in the first prior art shown in FIG. 1, a light emitting device control circuit comprises a power stage control circuit 21 for controlling a power transistor in a power stage 22 to convert an input voltage Vin to an output voltage, which is provided to multiple LED channels CH1-CHn. The power stage circuit 22 may be, for example but not limited to, asynchronously or asynchronously buck, boost, buck-boost, inverting or fly back voltage converter shown in FIGS. 3A-3G, wherein if the power stage circuit 22 is the fly back voltage converter shown in FIG. 3G, the power stage control circuit 21 and the dimming control circuit 23 are usually separated in different integrated circuits. In other cases, the power stage control circuit 21 and the dimming control circuit 23 can be integrated in the same integrated circuit. The dimming control circuit 23 provides the same dimming control signal to all LED channels CH1-CHn, synchronously controlling the transistors Q1-Qn on the channel paths. An example of such prior art is U.S. Pat. No. 7,259,687.

In the second prior art shown in FIG. 2, different dimming control circuits 23A, 23B, and 23N are used to adjust the brightness of corresponding light emitting device strings. An example of such prior art is US Patent Publication No. 2009/0134817.

However, if the same dimming control signal is used to synchronously control all light emitting device strings, all light emitting devices would be synchronous in their ON/OFF cycles, which would cause a larger ripple in the output voltage and current, and also a more serious flicker effect. A better arrangement is to turn ON the light emitting device strings in sequential order and to uniformly distribute the illumination timings of the light emitting device strings. Although the illumination timing of each light emitting device string can be independent from another string by controlling the light emitting device strings respectively, this can not ensure that the illumination timings of the light emitting device strings are uniformly distributed.

Besides, the frequency of a digital dimming signal is in a range of about 60-500 Hz, but in some applications it is difficult to provide a signal of such low frequency.

In view of the above, the present invention proposes a digital dimming device and method which can solve the problem of non-uniform distribution of illumination timings, and furthermore it can receive digital dimming signals in any frequency range.

SUMMARY OF THE INVENTION

An objective of the present invention is to provide a digital dimming device.

Another objective of the present invention is to provide a digital dimming method.

To achieve the foregoing objectives, in one perspective of the present invention, it provides a digital dimming device for controlling a plurality of light emitting device channels, comprising: a driving signal generation circuit generating a driving signal; a plurality of driver circuits which control currents in the plurality of light emitting device channels according to the driving signal, respectively; and a phase shift circuit receiving a PWM (pulse width modulation) input signal having a duty ratio, and shifting the phase of the PWM input signal to generate multiple PWM output signals with about the same duty ratio as the PWM input signal, but with respectively shifted phases, wherein the multiple PWM output signals respectively enable or disable corresponding driver circuits, and the duty ratio of each PWM output signal determines an average current of a corresponding one of light emitting device channels.

The foregoing digital dimming device may further comprise: a frequency conversion circuit receiving a dimming input signal with a first frequency and generating the PWM input signal with a second frequency which is sent to the phase shift circuit.

In another perspective of the present invention, it provides a digital dimming method for controlling a plurality of light emitting device channels, comprising: generating a corresponding plurality of driving signals to control the plurality of light emitting device channels; receiving a PWM input signal having a duty ratio, and phase shifting the PWM input signal to generate multiple PWM output signals with about the same duty ratio as the PWM input signal, but with respectively shifted phases; and enabling or disabling corresponding driving signals by the multiple PWM output signals, respectively.

The foregoing digital dimming method may further comprise: receiving a dimming input signal with a first frequency and generating the PWM input signal with a second frequency.

The foregoing digital dimming method may generate multiple PWM output signals with respectively shifted phases by the following way: recording a pulse width of the PWM input signal; recording a cycle period of the PWM input signal; dividing the cycle period by the number of light emitting device channels to obtain a quotient; and generating multiple PWM output signals according to the recorded cycle period and the quotient, wherein each of the cycle periods of the multiple PWM output signals starts at a different timing which differs from one another by the quotient.

The foregoing digital dimming method may convert the first frequency to the second frequency by the following way: recording a high-level pulse width of the dimming input signal; dividing the high-level pulse width by m which is the ratio of the second frequency to the first frequency; recording a low-level pulse width of the dimming input signal; dividing the low-level pulse width by m; and generating the PWM input signal with the second frequency according to the high-level and low-level pulse widths divided by m.

The foregoing digital dimming method may convert the first frequency to the second frequency also by the following way: generating an operating frequency substantially equal to or near to the first frequency; generating the second frequency; recording a high-level pulse width of the dimming input signal by the operating frequency; recording a low-level pulse width of the dimming input signal by the operating frequency; and generating the PWM input signal according to the high-level and low-level pulse widths, by the second frequency.

The objectives, technical details, features, and effects of the present invention will be better understood with regard to the detailed description of the embodiments below, with reference to the drawings.

DESCRIPTION OF THE PREFERRED EMBODIMENTS

Figure 1:
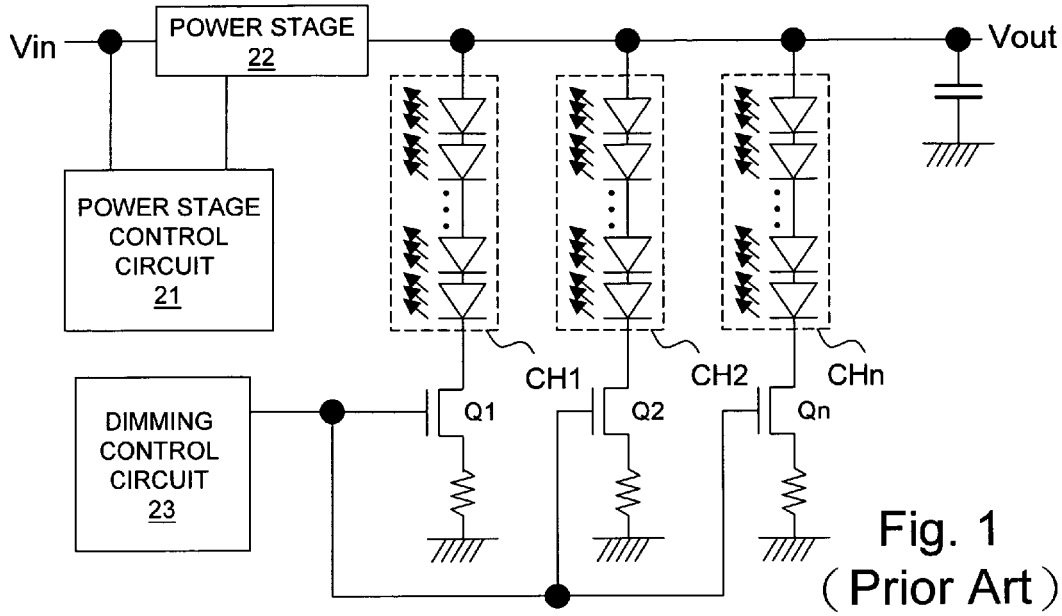
Fig. 1 (Prior Art)
FIG. 1 illustrates a conventional light emitting device control circuit whose drawback is that the illumination timings of the light emitting device strings are not uniformly distributed.
Figure 2:
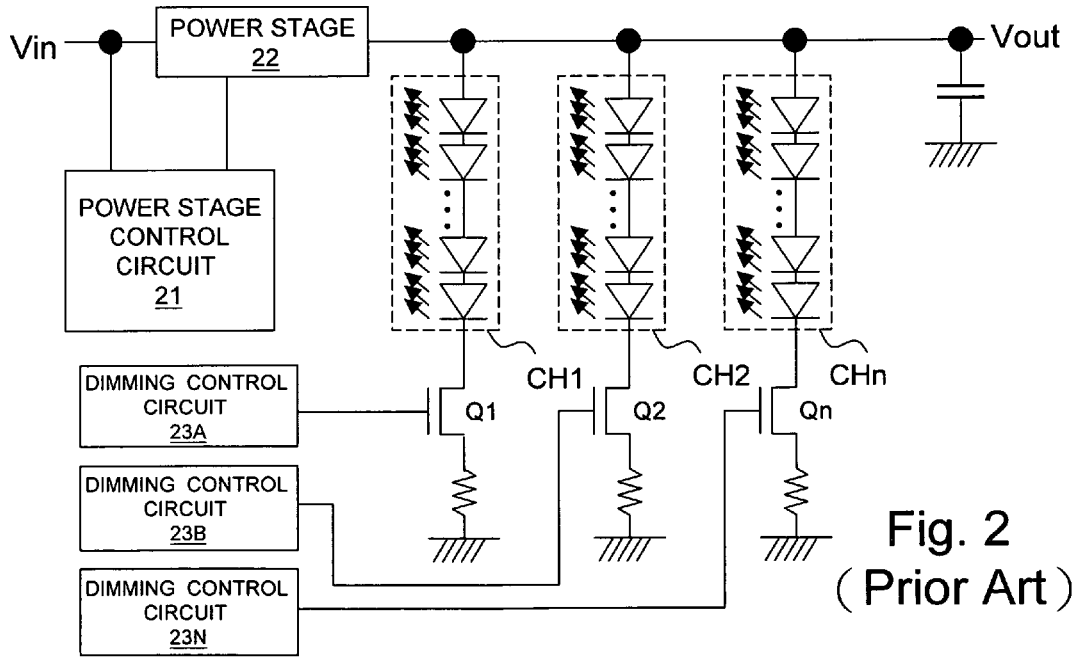
Fig. 2 (Prior Art)
FIG. 2 illustrates another conventional circuit which has the same drawback as well.
Figure 3A:
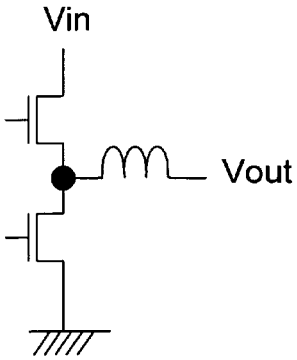
FIGS. 3A-3G show several embodiments of the power stage circuit 22.
Figure 3B:
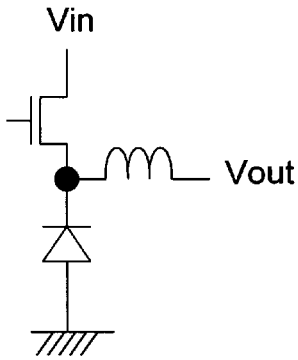
Figure 3C:
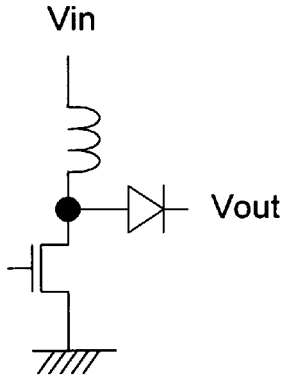
Figure 3D:
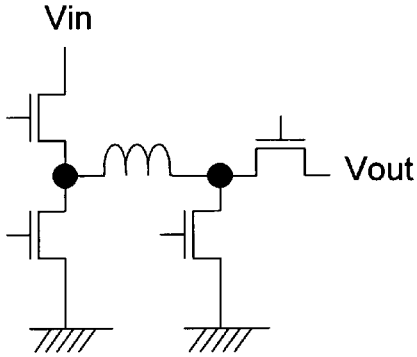
Figure 3E:
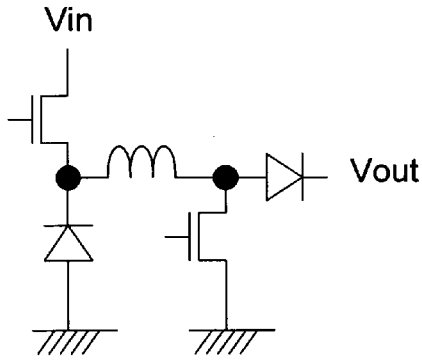
Figure 3F:
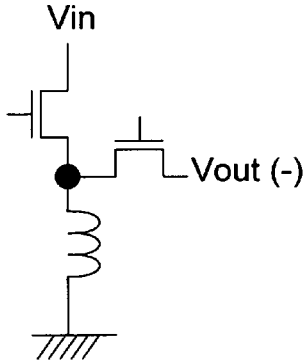
Figure 3G:
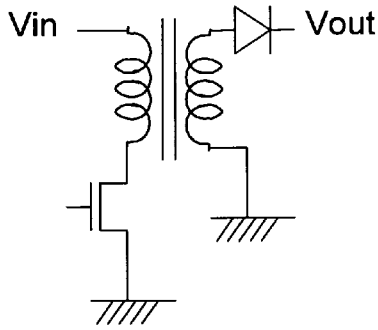
Figure 4:
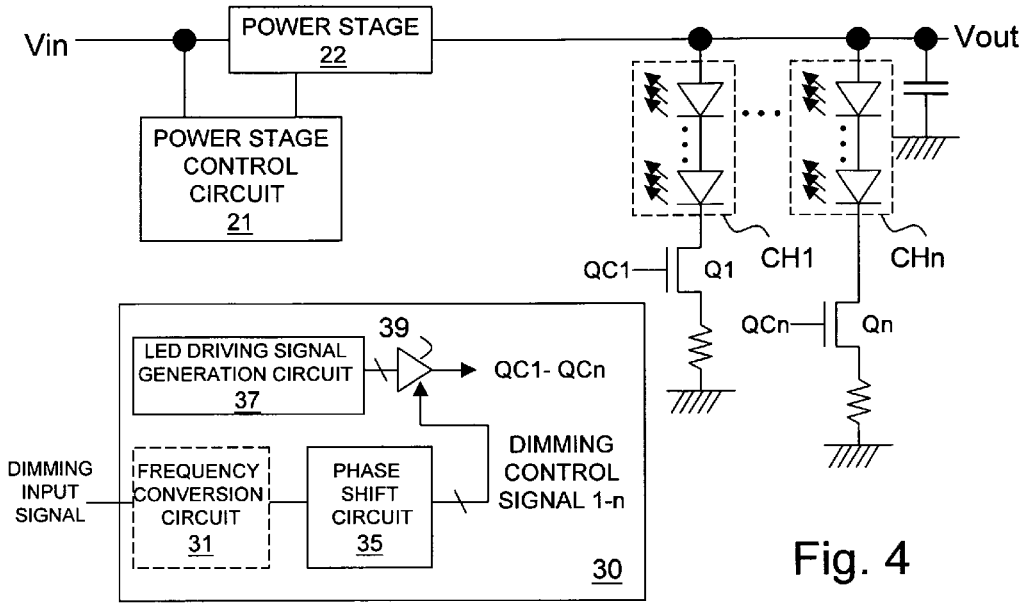
FIG. 4 shows an embodiment of the present invention.

In present invention, the digital dimming device or the digital dimming method generates multiple PWM output signals with respectively shifted phases, to turn ON the light emitting devices of different channels in sequential order, so that the illumination timings are uniformly distributed. Please refer to FIG. 4, which shows the first embodiment of the present invention, wherein a digital dimming device 30 comprises a phase shift circuit 35, a light emitting diode (LED) driving signal generation circuit 37, a plurality of driver circuits 39 (only one is shown), and optionally, a frequency conversion circuit 31. When the frequency of a dimming input signal is not in a proper range (60-500 Hz, for example), no matter it is too low or too high, the frequency conversion circuit 31 can receive and convert the dimming input signal into a signal with about the same duty ratio but with a proper frequency. The details about the frequency conversion circuit 31 will be described later. If the dimming input signal is already in the proper range, then the frequency conversion circuit 31 is not required.

The LED driving signal generation circuit 37 generates n driving signals QC1-QCn through the driver circuits 39 to control gates of transistors Q1-Qn in corresponding LED channels CH1-CHn; the driving signals QC1-QCn determine the current amounts on the corresponding LED channels CH1-CHn when the transistors Q1-Qn are conducted. The phase shift circuit 35 generates n dimming control signals 1-*n* with shifted phases according to the dimming input signal or the output of the frequency conversion circuit 31, the number of the signals corresponds to the number of LED channels. The dimming control signals 1-*n* are digital square wave signals which enable the driver circuits 39 at high level while disable the outputs of the driver circuits 39 at low level. In other words, the duty ratio of the dimming control signals 1-*n* determines the average currents on the corresponding LED channels CH1-CHn, that is, the average brightness of the LEDs on each LED channel. The details about the phase shift circuit 35 will be described later.

Figure 5:
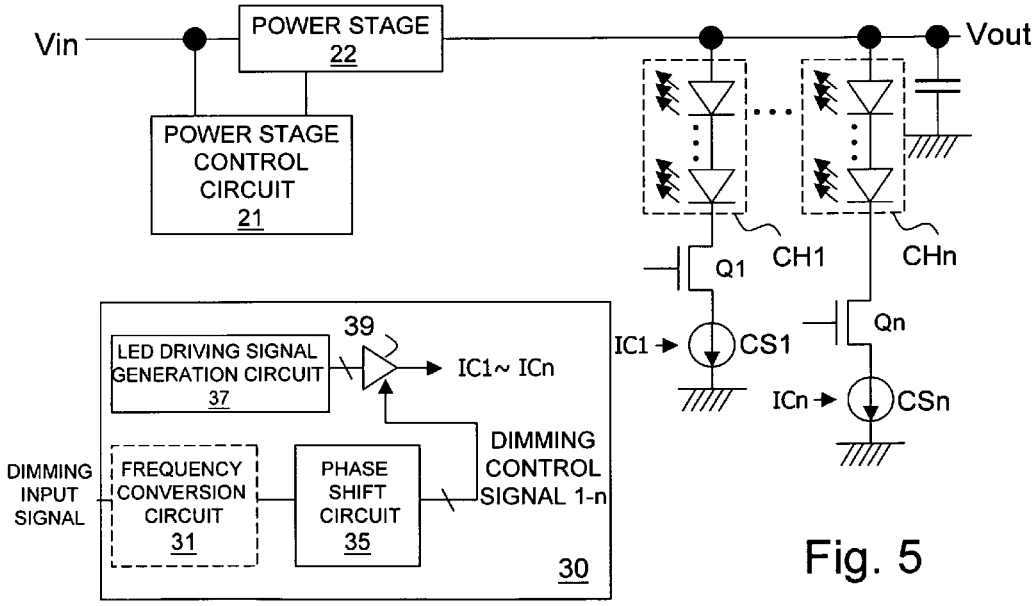
FIG. 5 shows another embodiment of the present invention.

FIG. 5 shows another embodiment of the present invention, wherein the LED driving signal generation circuit 37 generates n driving signals IC1-ICn through the driver circuits 39 to control current sources CS1-CSn in corresponding LED channels CH1-CHn, instead of the gates of transistors Q1-Qn. This also is an alternative to achieve the same function as the foregoing embodiment.

Figure 6:
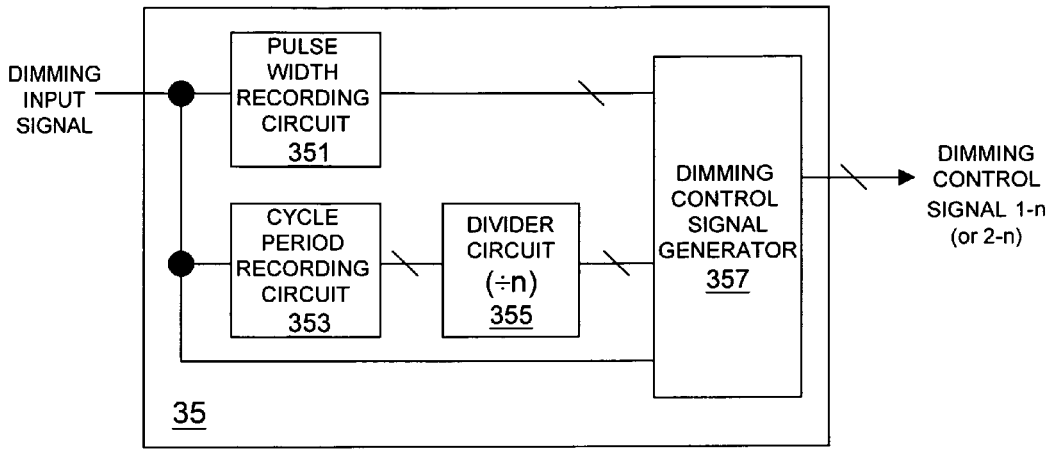
FIG. 6 shows an embodiment of a phase shift circuit.

FIG. 6 shows an example of the phase shift circuit 35. In this embodiment, the phase shift circuit 35 comprises a pulse width recording circuit 351, a cycle period recording circuit 353, a divider circuit 355, and a dimming control signal generator 357. When the phase shift circuit 35 receives a dimming signal (directly, or after frequency conversion by the frequency conversion circuit 31), the pulse width recording circuit 351 records a high-level pulse width of the dimming input signal and sends a corresponding digital data to the dimming control signal generator 357. On the other hand, the cycle period recording circuit 353 records a cycle period T of the dimming input signal, and the divider circuit 355 divides the recorded cycle period T by n and sends the digital data (T/n) to the dimming control signal generator 357, wherein n corresponds to the number of the light emitting device channels. The dimming control signal generator 357 generates multiple phase-shifted dimming control signals 1-*n* according to the high-level pulse width and the digital data (T/n).

Figure 7:
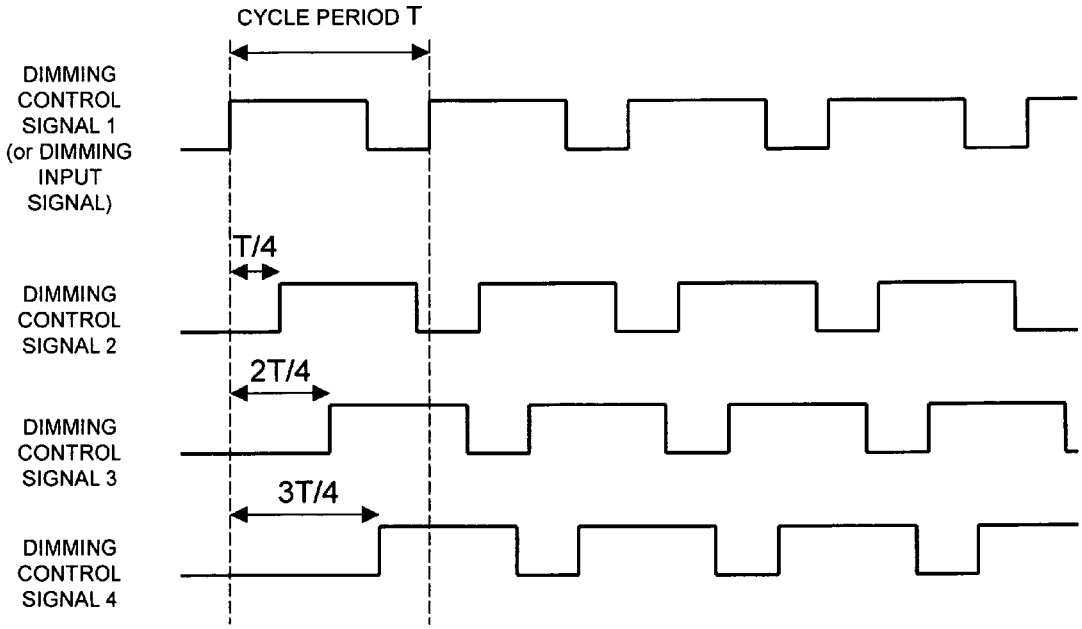
FIG. 7 shows, by way of example, the output waveforms of the phase shift circuit.

What is described above can be better understood with reference to the example shown in FIG. 7. In this example, n (the number of channels) is 4, so each of the dimming control signals 1-*n* generated by the phase shift circuit 35 starts at a different timing which differs from one another by T/4, but has the same high-level pulse width.

The above description is for easier understanding of the basic concept of the present invention. In fact, because the dimming input signal itself is a PWM signal having a correct duty ratio, the phase shift circuit 35 can merely generate (n−1) dimming control signals 2-*n*, and the dimming input signal can be used as the first dimming control signal 1 without being processed by the phase shift circuit 35. Under the teaching of the present invention, those skilled in this art can readily conceive other variations and modifications.

Hereafter we will illustrate two examples to embody the frequency conversion circuit 31. As described above, the dimming input signal might not be in the proper range, and the function of the frequency conversion circuit 31 is to divide the frequency of the dimming input signal (if its frequency is too high) or to multiply the frequency of the dimming input signal (if its frequency is too low), so as to generate a frequency-converted dimming input signal which is in a proper frequency range, with the same duty ratio.

Figure 8:
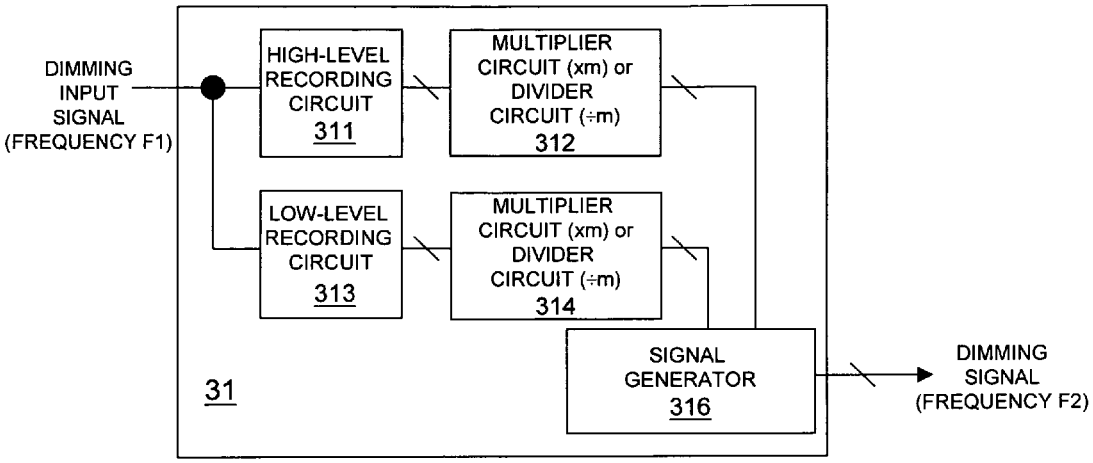
FIG. 8 shows an embodiment of a frequency conversion circuit.

First referring to FIG. 8, the frequency conversion circuit 31 in this embodiment comprises a high-level recording circuit 311, a multiplier or divider circuit 312, a low-level recording circuit 313, a multiplier or divider circuit 314, and a signal generator 316. When the frequency conversion circuit 31 receives a dimming input signal with a frequency F1, the high-level recording circuit 311 records the high-level pulse width of the dimming input signal and the low-level recording circuit 313 records the low-level pulse width of the dimming input signal. Depending on whether multiplication or division is required, the multiplier or divider circuits 312 and 314 multiply or divide the recorded high-level and low-level pulse widths by m, which represents a ratio of the frequency F1 of the dimming input signal to a frequency F2 of the dimming signal to be generated, that is, m=F2/F1 (when the frequency of the dimming input signal is below the proper range) or F1/F2 (when the frequency of the dimming input signal is above the proper range). The signal generator 316 generates the dimming signal having the frequency F2 according to the high-level and low-level pulse widths from the multiplier or divider circuits 312 and 314.

Figure 9:
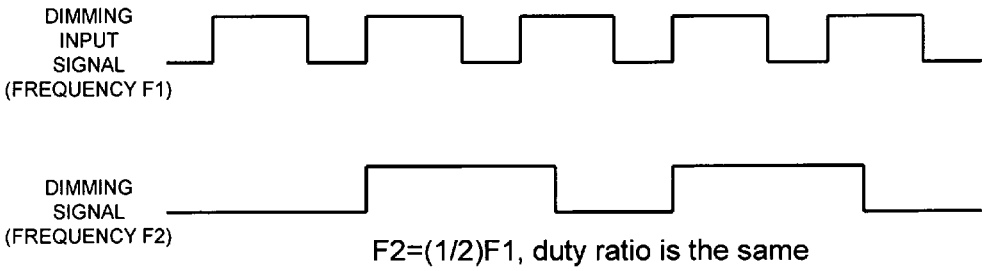
FIG. 9 shows, by way of example, the input and output waveforms of the frequency conversion circuit in FIG. 8.

What is described above can be better understood with reference to the example shown in FIG. 9. In this example, F2=(1/2)F1, that is, the circuits 312 and 314 are divider circuits and m=2. The signal generator 316 combines the high-level and low-level signals with double pulse widths to generate the dimming signal shown in the figure, which can be used as the dimming input signal in FIG. 6.

Figure 10:
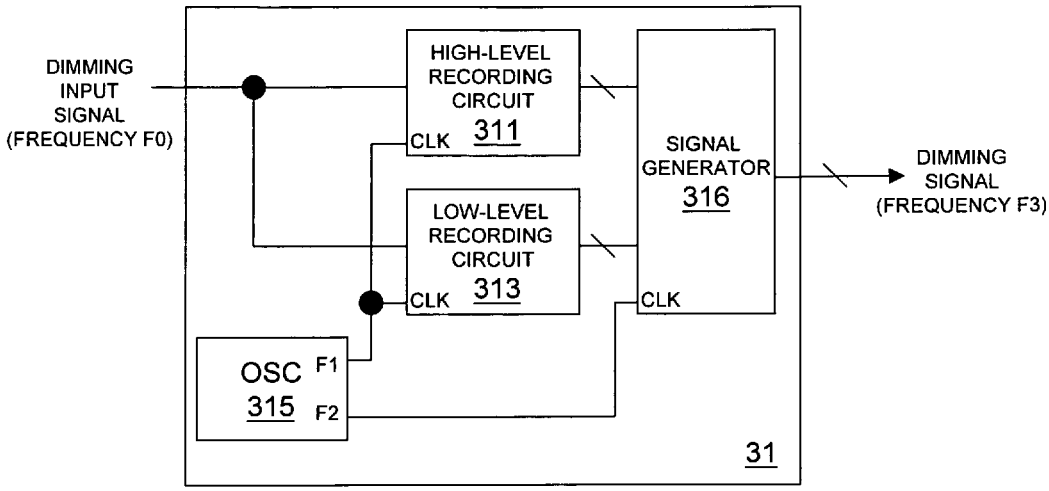
FIG. 10 shows another embodiment of the frequency conversion circuit.
Figure 11:
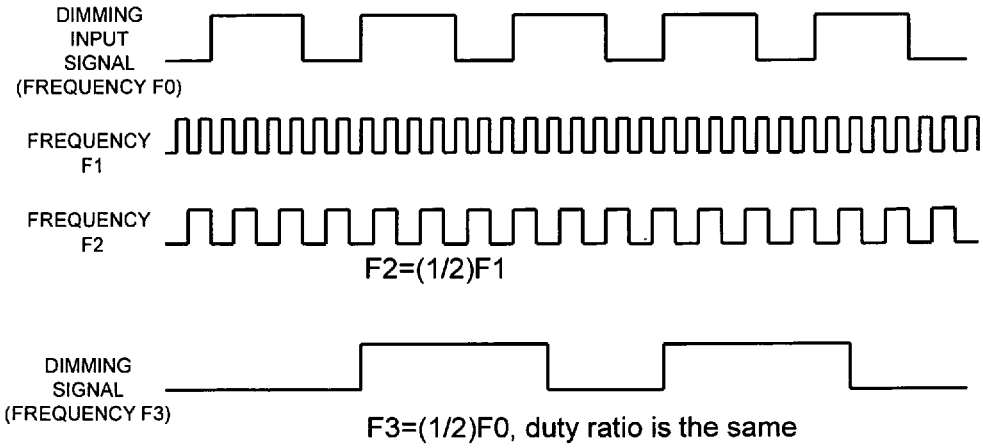
FIG. 11 shows, by way of example, the input and output waveforms of the frequency conversion circuit in FIG. 10.

FIG. 10 shows another embodiment of the frequency conversion circuit 31, wherein the frequency conversion circuit 31 comprises a high-level recording circuit 311, a low-level recording circuit 313, an oscillator (OSC) 315, and a signal generator 316. In this embodiment, the frequency of the dimming input signal is F0 while the frequency of the dimming signal to be outputted is F3, and the conversion ratio to be achieved is, for example, 1/2 (F3/F0=1/2). The oscillator (OSC) 315 generates two sample frequencies F1 and F2 in high-frequency, which are both much higher than the frequency F0 of the dimming input signal, and the ratio of F1 to F2 is the same as the ratio of F0 to F3, that is, F2/F1=1/2. The high-level and low-level recording circuits 311 and 313 operate under the frequency F1 generated by the oscillator (OSC) 315, and the signal generator 316 operates under the frequency F2 generated by the oscillator (OSC) 315. Similar to the previous embodiment, the high-level and low-level recording circuits 311 and 313 record the high-level and low-level pulse widths, and send corresponding digital data to the signal generator 316 which combines the high-level and low-level pulse widths to generate an output. But, because the signal generator 316 operates under a frequency F2 which is half of F1, the frequency F3 of the dimming signal outputted from the signal generator 316 is also half of F0, as shown in FIG. 11.

As described above, the frequency conversion circuit 31 converts the dimming input signal to a signal with about the same duty ratio but with a proper frequency, such that the dimming control can be based on the proper frequency. Note that, such frequency conversion can be applied to a single-channel LED controller circuit, not limited to multi-channel LED controller circuit. In the case of single-channel LED control, referring to FIGS. 4 and 5, it is not required for the digital dimming device 30 to include the phase shift circuit 35; the digital dimming device 30 only includes the frequency conversion circuit 31, one LED driving signal generation circuit 37 and one driver circuit 39.

The present invention has been described in considerable detail with reference to certain preferred embodiments thereof. It should be understood that the description is for illustrative purpose, not for limiting the scope of the present invention. Those skilled in this art can readily conceive variations and modifications within the spirit of the present invention. For example, it is described that the high-level pulse width of the dimming signal is used to determine the light emitting time of the light emitting devices, but the light emitting time can alternatively be determined by the low-level pulse width. As yet another example, the light emitting device is not necessarily a light emitting diode, but can be any light emitting device whose brightness can be controlled by current. Further, in the present invention, the power stage control circuit 21 and the dimming control circuit 23 can be integrated in the same integrated circuit or separated into two integrated circuits, and in the latter case the current sources CS1-CSn can be, for example, integrated with the digital dimming device 30 in one integrated circuit. Thus, the present invention should cover all such and other modifications and variations, which should be interpreted to fall within the scope of the following claims and their equivalents.

What is claimed is:

1. A digital dimming device for controlling a plurality of light emitting device channels, comprising:

a driving signal generation circuit generating a driving signal;

a plurality of driver circuits which control currents in the plurality of light emitting device channels according to the driving signal, respectively; and a phase shift circuit receiving a PWM (pulse width modulation) input signal having a duty ratio, and shifting the phase of the PWM input signal to generate multiple PWM output signals with about the same duty ratio as the PWM input signal, but with respectively shifted phases, wherein the phase shift circuit comprises:

a pulse width recording circuit recording a pulse width of the PWM input signal;

a cycle period recording circuit recording a cycle period of the PWM input signal;

a divider circuit dividing the cycle period by the number of the light emitting device channels to obtain a quotient; and a dimming control signal generator generating the multiple PWM output signals according to the recorded cycle period and the quotient, wherein each of the cycle periods of the multiple PWM output signals starts at a different timing which differs from one another by the quotient, wherein the multiple PWM output signals respectively enable or disable corresponding driver circuits, and the duty ratio of each PWM output signal determines an average current of a corresponding one of light emitting device channels.

2. The digital dimming device of claim 1, wherein the PWM input signal is used as one of the PWM output signals so that the number of the PWM output signals is one less than the number of the light emitting device channels.

3. The digital dimming device of claim 1, further comprising: a frequency conversion circuit receiving a dimming input signal with a first frequency and generating the PWM input signal with a second frequency which is sent to the phase shift circuit.

4. A digital dimming device for controlling a plurality of light emitting device channels, comprising:

a driving signal generation circuit generating a driving signal;

a plurality of driver circuits which control currents in the plurality of light emitting device channels according to the driving signal, respectively;

a frequency conversion circuit receiving a dimming input signal with a first frequency and generating a PWM (pulse width modulation) input signal with a second frequency, the PWM input signal having a duty ratio; and a phase shift circuit receiving the PWM input signal, and shifting the phase of the PWM input signal to generate multiple PWM output signals with about the same duty ratio as the PWM input signal, but with respectively shifted phases, wherein the multiple PWM output signals respectively enable or disable corresponding driver circuits, and the duty ratio of each PWM output signal determines an average current of a corresponding one of light emitting device channels; and wherein the frequency conversion circuit comprises:

a high-level recording circuit recording a high-level pulse width of the dimming input signal;

a first multiplier circuit multiplying the high-level pulse width by m which is the ratio of the second frequency to the first frequency;

a low-level recording circuit recording a low-level pulse width of the dimming input signal;

a second multiplier circuit multiplying the low-level pulse width by m; and a signal generator generating the PWM input signal with the second frequency according to the high-level and low-level pulse widths from the first and second multiplier circuits.

5. A digital dimming device for controlling a plurality of light emitting device channels, comprising:

a driving signal generation circuit generating a driving signal;

a plurality of driver circuits which control currents in the plurality of light emitting device channels according to the driving signal, respectively;

a frequency conversion circuit receiving a dimming input signal with a first frequency and generating a PWM (pulse width modulation) input signal with a second frequency, the PWM input signal having a duty ratio; and a phase shift circuit receiving the PWM input signal, and shifting the phase of the PWM input signal to generate multiple PWM output signals with about the same duty ratio as the PWM input signal, but with respectively shifted phases, wherein the multiple PWM output signals respectively enable or disable corresponding driver circuits, and the duty ratio of each PWM output signal determines an average current of a corresponding one of light emitting device channels; and wherein the frequency conversion circuit comprises:

a high-level recording circuit recording a high-level pulse width of the dimming input signal;

a first divider circuit dividing the high-level pulse width by m which is the ratio of the second frequency to the first frequency;

a low-level recording circuit recording a low-level pulse width of the dimming input signal;

a second divider circuit dividing the low-level pulse width by m; and a signal generator generating the PWM input signal with the second frequency according to the high-level and low-level pulse widths from the first and second divider circuits.

6. A digital dimming device for controlling a plurality of light emitting device channels, comprising:

a driving signal generation circuit generating a driving signal;

a plurality of driver circuits which control currents in the plurality of light emitting device channels according to the driving signal, respectively;

a frequency conversion circuit receiving a dimming input signal with a first frequency and generating a PWM (pulse width modulation) input signal with a second frequency, the PWM input signal having a duty ratio; and a phase shift circuit receiving the PWM input signal, and shifting the phase of the PWM input signal to generate multiple PWM output signals with about the same duty ratio as the PWM input signal, but with respectively shifted phases, wherein the multiple PWM output signals respectively enable or disable corresponding driver circuits, and the duty ratio of each PWM output signal determines an average current of a corresponding one of light emitting device channels; and wherein the frequency conversion circuit comprises:

a high-level recording circuit recording a high-level pulse width of the dimming input signal;

a low-level recording circuit recording a low-level pulse width of the dimming input signal;

a signal generator generating the PWM input signal with the second frequency according to the high-level and low-level pulse widths; and an oscillator generating a frequency substantially equal to or near to the first frequency as the operating frequency of the high-level and the low-level recording circuits, and generating the second frequency as the operating frequency of the signal generator.

7. The digital dimming device of claim 1, wherein each of the light emitting device channels has a transistor, whose gate is controlled by a corresponding one of the driving circuits.

8. The digital dimming device of claim 1, wherein each of the light emitting device channels has a current source, whose current amount is controlled by a corresponding one of the driving circuits.

9. A digital dimming method for controlling a plurality of light emitting device channels, comprising:

generating a corresponding plurality of driving signals to control the plurality of light emitting device channels;

receiving a PWM input signal having a duty ratio, and phase shifting the PWM input signal to generate multiple PWM output signals with about the same duty ratio as the PWM input signal, but with respectively shifted phases; and enabling or disabling corresponding driving signals by the multiple PWM output signals, respectively, wherein the step of receiving and phase shifting a PWM input signal comprises:

recording a pulse width of the PWM input signal;

recording a cycle period of the PWM input signal;

dividing the cycle period by the number of light emitting device channels to obtain a quotient; and generating multiple PWM output signals according to the recorded cycle period and the quotient, wherein each of the cycle periods of the multiple PWM output signals starts at a different timing which differs from one another by the quotient.

10. The method of claim 9, further comprising: receiving a dimming input signal with a first frequency and generating the PWM input signal with a second frequency.

11. A digital dimming method for controlling a plurality of light emitting device channels, comprising:

generating a corresponding plurality of driving signals to control the plurality of light emitting device channels;

receiving a dimming input signal with a first frequency and generating a PWM input signal with a second frequency, the PWM input signal having a duty ratio;

phase shifting the PWM input signal to generate multiple PWM output signals with about the same duty ratio as the PWM input signal, but with respectively shifted phases; and enabling or disabling corresponding driving signals by the multiple PWM output signals, respectively;

wherein the step of receiving a dimming input signal with a first frequency and generating a PWM input signal with a second frequency comprises:

recording a high-level pulse width of the dimming input signal;

multiplying the high-level pulse width by m which is the ratio of the second frequency to the first frequency;

recording a low-level pulse width of the dimming input signal;

multiplying the low-level pulse width by m; and generating the PWM input signal with the second frequency according to the high-level and low-level pulse widths multiplied by m.

12. A digital dimming method for controlling a plurality of light emitting device channels, comprising:

generating a corresponding plurality of driving signals to control the plurality of light emitting device channels;

receiving a dimming input signal with a first frequency and generating a PWM input signal with a second frequency, the PWM input signal having a duty ratio;

phase shifting the PWM input signal to generate multiple PWM output signals with about the same duty ratio as the PWM input signal, but with respectively shifted phases; and enabling or disabling corresponding driving signals by the multiple PWM output signals, respectively;

wherein the step of receiving a dimming input signal with a first frequency and generating a PWM input signal with a second frequency comprises:

recording a high-level pulse width of the dimming input signal;

dividing the high-level pulse width by m which is the ratio of the second frequency to the first frequency;

recording a low-level pulse width of the dimming input signal;

dividing the low-level pulse width by m; and generating the PWM input signal with the second frequency according to the high-level and low-level pulse widths divided by m.

13. A digital dimming method for controlling a plurality of light emitting device channels, comprising:

generating a corresponding plurality of driving signals to control the plurality of light emitting device channels;

receiving a dimming input signal with a first frequency and generating a PWM input signal with a second frequency, the PWM input signal having a duty ratio;

phase shifting the PWM input signal to generate multiple PWM output signals with about the same duty ratio as the PWM input signal, but with respectively shifted phases; and enabling or disabling corresponding driving signals by the multiple PWM output signals, respectively;

wherein the step of receiving a dimming input signal with a first frequency and generating a PWM input signal with a second frequency comprises:

generating an operating frequency substantially equal to or near to the first frequency;

generating the second frequency;

recording a high-level pulse width of the dimming input signal by the operating frequency;

recording a low-level pulse width of the dimming input signal by the operating frequency; and generating the PWM input signal according to the high-level and low-level pulse widths, by the second frequency.

14. The digital dimming method of claim 9, wherein each of the light emitting device channels has a transistor and the step of controlling the plurality of the light emitting device channels comprises: controlling the gates of the transistors respectively.

15. The digital dimming method of claim 9, wherein each of the light emitting device channels has a current source and the step of controlling the plurality of the light emitting device channels comprises: controlling the current amounts of the current sources respectively.

* * * * *